US008485784B2

(12) United States Patent
Eastman et al.

(10) Patent No.: US 8,485,784 B2
(45) Date of Patent: Jul. 16, 2013

(54) TURBINE BUCKET LOCKWIRE ROTATION PREVENTION

(75) Inventors: John Alan Eastman, Simpsonville, SC (US); Brian Peter Arness, Greenville, SC (US); Mark Steven Honkomp, Taylors, SC (US); Stephen Paul Wassynger, Simpsonville, SC (US); Steve P. Byam, Fountain Inn, SC (US); Michael Reinker, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1036 days.

(21) Appl. No.: 12/502,715

(22) Filed: Jul. 14, 2009

(65) Prior Publication Data

US 2011/0014053 A1 Jan. 20, 2011

(51) Int. Cl.
*F01D 5/32* (2006.01)

(52) U.S. Cl.
USPC ..... 416/220 R

(58) Field of Classification Search
USPC ..... 416/219 R, 220 R, 221, 228
See application file for complete search history.

(56) References Cited

U.S. PATENT DOCUMENTS

| | | | | |
|---|---|---|---|---|
| 3,165,294 | A | 1/1965 | Anderson | |
| 3,521,974 | A | 7/1970 | Zerlauth | |
| 3,604,702 | A | 9/1971 | Jensen et al. | |
| 4,208,170 | A | 6/1980 | Tucker et al. | |
| 4,221,542 | A * | 9/1980 | Acres et al. | 416/220 R |
| 4,265,595 | A | 5/1981 | Bucy, Jr. et al. | |
| 4,453,891 | A | 6/1984 | Forestier | |
| 5,261,790 | A | 11/1993 | Dietz et al. | |
| 5,263,898 | A | 11/1993 | Elston, III et al. | |
| 5,338,154 | A * | 8/1994 | Meade et al. | 415/173.7 |
| 5,350,279 | A | 9/1994 | Prentice et al. | |
| 5,368,444 | A | 11/1994 | Anderson | |
| 5,713,721 | A | 2/1998 | Glynn et al. | |
| 5,988,980 | A | 11/1999 | Busbey et al. | |
| 6,010,304 | A | 1/2000 | Moniz et al. | |
| 6,190,131 | B1 * | 2/2001 | Deallenbach | 416/144 |
| 6,398,500 | B2 | 6/2002 | Pedersen et al. | |
| 6,457,942 | B1 | 10/2002 | Forrester | |
| 6,796,769 | B2 | 9/2004 | Moroso | |
| 6,820,468 | B2 | 11/2004 | Powers et al. | |
| 6,851,932 | B2 | 2/2005 | Lagrange et al. | |
| 6,884,028 | B2 | 4/2005 | Brauer et al. | |
| 6,890,248 | B2 | 5/2005 | Whitmarsh et al. | |

(Continued)

OTHER PUBLICATIONS

U.S. Appl. No. 12/899,305, filed Oct. 6, 2012 (pending).

(Continued)

*Primary Examiner* — Edward Look
*Assistant Examiner* — Woody A Lee, Jr.
(74) *Attorney, Agent, or Firm* — Nixon & Vanderhye, P.C.

(57) ABSTRACT

A retention system for a plurality of turbine buckets located in respective mating slots in a turbine rotor wheel includes a plurality of first retention slots formed in outer peripheral portions of the turbine wheel, and a plurality of second retention slots formed in wheel mounting portions of the buckets. The first and second retention slots are aligned to form an annular retention slot extending about a peripheral portion of the rotor wheel. A lockwire is located within the annular retention slot, the lockwire having engaged free ends. A plurality of axially-oriented retaining pins are fixed in the rotor wheel to hold the lockwire in the annular retention slot, and various techniques are employed for at least limiting or substantially preventing circumferential rotation of the lockwire within the annular slot.

10 Claims, 4 Drawing Sheets

U.S. PATENT DOCUMENTS

| | | | | |
|---|---|---|---|---|
| 6,981,847 | B2 | 1/2006 | Arinci et al. | |
| 7,410,345 | B2 | 8/2008 | Bracken | |
| 8,061,995 | B2 | 11/2011 | Prince et al. | |
| 2008/0298972 | A1* | 12/2008 | Le Hong | 416/219 R |
| 2009/0148298 | A1* | 6/2009 | Strohl et al. | 416/219 R |

OTHER PUBLICATIONS

U.S. Appl. No. 12/984,358, filed Jan. 4, 2011 (pending).

U.S. Appl. No. 13/116,068, filed May 26, 2011 (pending).

* cited by examiner

TURBINE BUCKET LOCKWIRE ROTATION PREVENTION

BACKGROUND OF THE INVENTION

The invention relates to a lockwire retention system used to prevent axial movement of a turbine bucket dovetail in a corresponding dovetail slot in a turbine rotor wheel, and more specifically, to techniques for preventing circumferential rotation of the lockwire itself within an annular groove in the turbine rotor wheel.

In conventional turbine and/or turbine compressor components, buckets (or blades, or airfoils) are held in a rotor wheel by means of a slotted connection, e.g., a so-called fir tree or Christmas tree arrangement where an inwardly-tapered male connector portion at the radially inner end of the bucket is received in a complimentary female slot in the rotor wheel. Such connections are also generically referred to as "dovetail" connections, embracing various complimentary shapes which lock the buckets to the wheel in the radial and circumferential directions so as to accommodate the high centrifugal forces generated by rotation of the turbine rotor.

The fit between the blade dovetail and the dovetail slot is somewhat loose to allow for assembly and tolerances. Therefore, if the blades are not properly retained, the loose fit may allow the bucket or blade to move axially along the slot, leading to excessive wear or even collisions with neighboring components. The excessive wear can eventually fail the part, requiring the unit to be shut down until a repair is made. Bucket translation is particularly worrisome for cooled buckets. Small amounts of axial displacement can block the inflow of air into the part and lead to premature failure.

In accordance with one known practice, the buckets or blades are prevented from moving axially in the dovetail slots provided in the rotor wheel by a lockwire passing through an annular slot formed in the radially outer periphery of the wheel, bridging the dovetail slots, and passing through circumferentially-aligned slots in the dovetail portions of the respective buckets. The free ends of the wire are shaped so that they come together at an overlapped joint, thus allowing for minor changes in diameter as the airfoils move radially within the respective dovetail slots. The overlap joint is more to allow for thermal expansion/contraction of both the wire and rotor during transient periods. The lockwire is held in place by pins mounted in the turbine wheel, radially inwardly of the lockwire. It has been discovered that rotation of the lockwire within the annular slot in the rotor wheel (which occurs over time) can cause one end of the lockwire to engage a pin and bend downwardly (radially inwardly) below the pin and escape the annular slot. Without the lockwire, the airfoils are free to travel axially along the dovetail slots, creating the potential for excessive wear and interference as mentioned above. In addition, this is especially consequential in first stage buckets that rely on holes in the base of the bucket to provide internal cooling. When these holes are blocked due to axial movement of the bucket, the bucket can quickly oxidize along the leading edge.

There remains a need for a reliable technique for preventing rotation of the lockwire within its annular slot to thereby prevent escape of the lockwire from the rotor wheel.

BRIEF DESCRIPTION OF THE INVENTION

In one exemplary embodiment, the invention relates to a retention system for a plurality of turbine buckets located in respective mating slots in a turbine rotor wheel, the retention system comprising a plurality of first retention slots formed in outer peripheral portions of the turbine wheel; a plurality of second retention slots formed in wheel mounting portions of said buckets, said first and second retention slots aligned to form an annular retention slot extending about a peripheral portion of said rotor wheel; a lockwire located within said annular retention slot, said lockwire having engaged free ends; a plurality of axially-oriented retaining pins fixed in said rotor wheel holding said lockwire in said annular retention slot; and means for at least limiting circumferential rotation of the lockwire within the annular slot.

In another aspect, the invention relates to a retention system retention system for a plurality of turbine buckets located in respective mating slots in a turbine rotor wheel, the retention system comprising a plurality of first retention slots formed in outer peripheral portions of the turbine wheel; a plurality of second retention slots formed in wheel mounting portions of the buckets, the first and second retention slots aligned to form an annular retention slot extending about a peripheral portion of said rotor wheel; a lockwire located within the annular retention slot, the lockwire having overlapped free ends; a plurality of axially-oriented retaining pins fixed in the rotor wheel holding the lockwire in the annular retention slot; and at least one notch formed in the lockwire in engagement with one of the retaining pins to thereby substantially prevent circumferential rotation of the lockwire within the annular slot.

In still another aspect, the invention relates to a retention system for a plurality of turbine buckets located in respective mating slots in a turbine rotor wheel, the retention system comprising a plurality of first retention slots formed in outer peripheral portions of the turbine wheel; a plurality of second retention slots formed in wheel mounting portions of the buckets, the first and second retention slots aligned to form an annular retention slot extending about a peripheral portion of the rotor wheel; a lockwire located within the annular retention slot, the lockwire having opposed free ends; a plurality of axially-oriented retaining pins fixed in the rotor wheel holding the lockwire in the annular retention slot; and wherein a leading free end of the lockwire is bent inwardly toward a centerline of the rotor wheel enabling engagement with an adjacent one of the retaining pins to thereby limit circumferential rotation of the lockwire within the annular retention slot.

In still another aspect, the invention relates to a retention system for a plurality of turbine buckets located in respective mating slots in a turbine rotor wheel, the retention system comprising a plurality of first retention slots formed in outer peripheral portions of the turbine wheel; a plurality of second retention slots formed in wheel mounting portions of said buckets, said first and second retention slots aligned to form an annular retention slot extending about a peripheral portion of said rotor wheel; a lockwire located within said annular retention slot, said lockwire having engaged free ends; a plurality of axially-oriented retaining pins fixed in said rotor wheel holding said lockwire in said annular retention slot; and means for at least limiting rotation of said lockwire in a circumferential direction within said annular slot.

The invention will now be described in detail in connection with the drawings identified below.

DETAILED DESCRIPTION OF THE INVENTION

Figure 1:
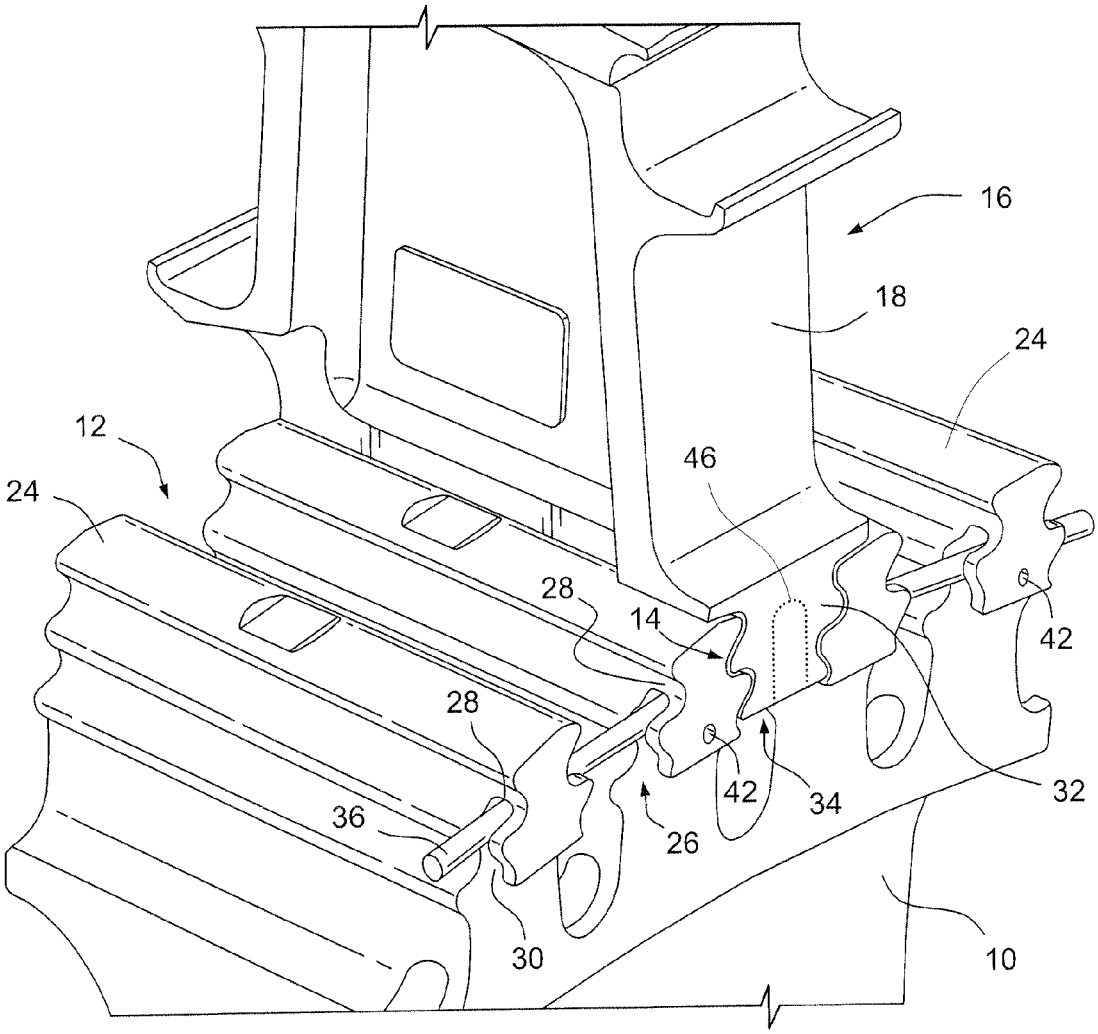
Fig. 1 (PRIOR ART)
FIG. 1 is a partial top perspective view of a known turbine rotor wheel and bucket assembly showing a lockwire in place.
Figure 2:
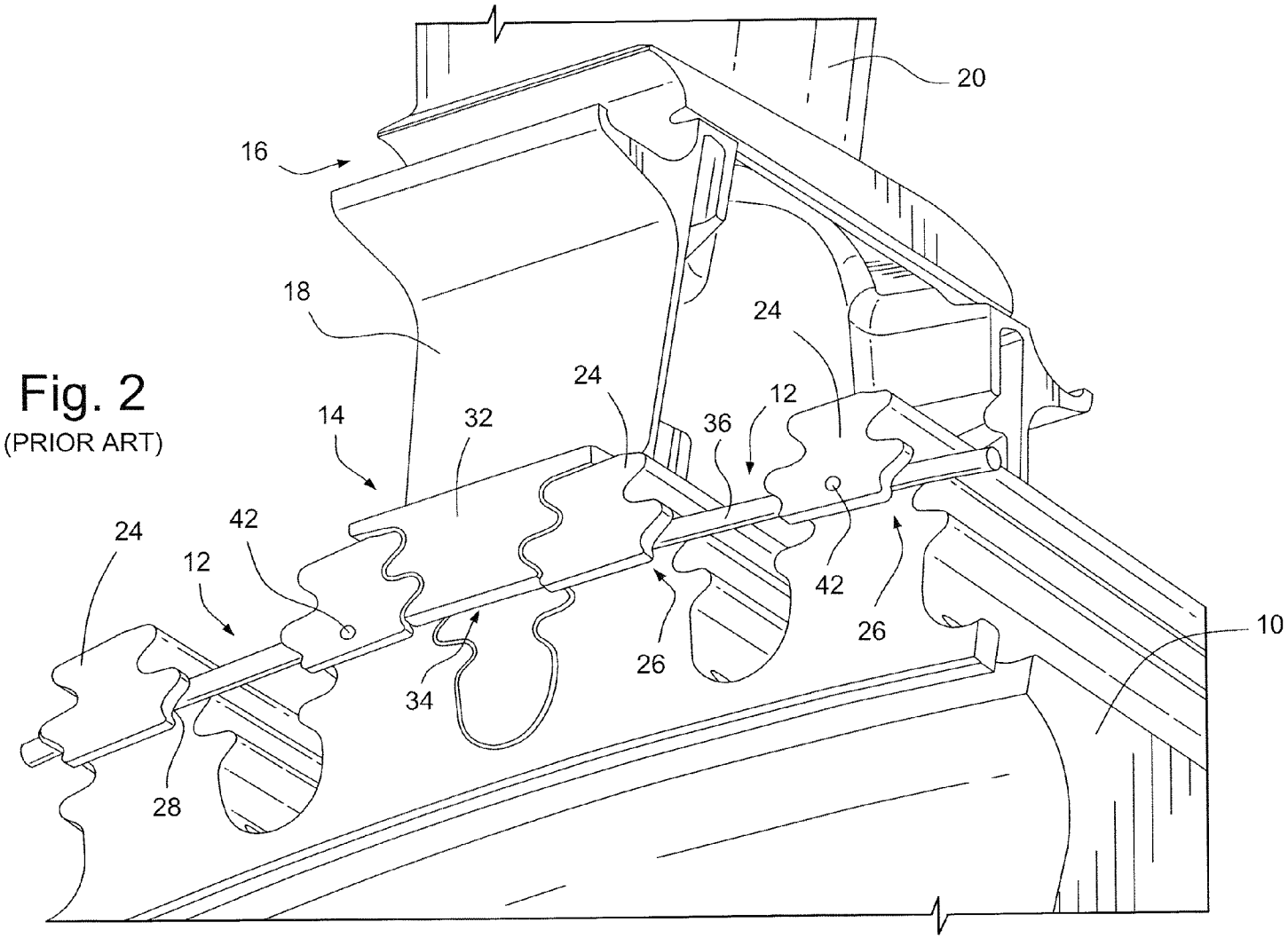
Fig. 2 (PRIOR ART)
FIG. 2 is a partial bottom perspective view of the rotor wheel and bucket assembly shown in FIG. 1.

FIGS. 1 and 2 illustrate a known technique for preventing axial movement of a turbine bucket received within a slot in a turbine rotor wheel. More specifically, the turbine rotor wheel 10 is formed with a plurality of dovetail slots 12 about the entire outer periphery of the wheel, each dovetail slot 12 receiving a complementary dovetail portion 14 of a bucket or blade 16 (only three complete slots and one bucket shown in the Figures). It will be understood that the bucket or blade 16 is of conventional construction, including a shank portion 16, an airfoil portion 20 and the dovetail portion (or simply, dovetail) 14.

The radially projecting portions 24 of the wheel which define the slots 12 are formed with first lockwire slots 26, each closed at its radially outer end 28 and open at its radially inner end 30. The first lockwire slots 26 are formed adjacent one side of the wheel, and together, form an annular 360° slot about the periphery of the wheel, interrupted by the dovetail slots 12. Axially offset portions (or lock tabs) 32 of the bucket dovetails 22 define a plurality of second lockwire slots 34 that are alignable with the first lockwire slots 26 upon introduction of the buckets 16 into the dovetail slots 12. A lockwire 36 (preferably a suitable metal alloy) may then be introduced into the aligned lockwire slots 26, 34 as shown in FIGS. 1 and 2, with free ends 38, 40 (see FIG. 3) shaped to smoothly overlap each other in a normally-installed condition. Axially-oriented pins 42 inserted through the portions 24 of the rotor wheel 10 are employed to hold the lockwire 36 within the lockwire slots 26.

Figure 3:
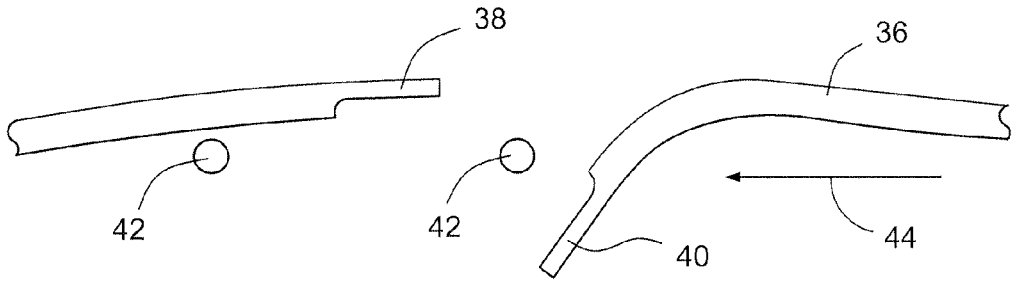
Fig. 3 (PRIOR ART)
FIG. 3 is a schematic representation of the free ends of a lockwire, with one end trapped below a retaining pin.

FIG. 3 illustrates a problem experienced with the lockwire configuration as described above. Specifically, it has been found that the lockwire 36 is prone to circumferential rotation during turbine operation due perhaps to thermal and/or mechanical ratcheting. Resulting separation of the free ends 38, 40 of the lockwire can result in one end (the trailing end in the direction of lockwire rotation) travelling below (i.e., radially inwardly) of one of the pins 42 so that during wheel rotation in the direction shown by arrow 44, the lockwire 36 may escape the lockwire slots 26, 34, thereby permitting axial movement of the buckets 16 within the dovetail slots 12.

Figure 4:
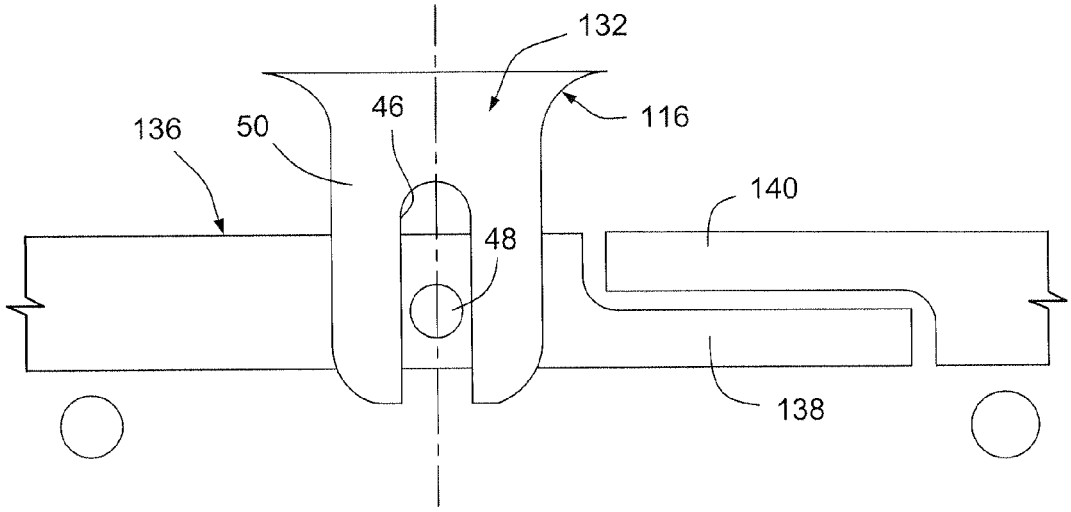
FIG. 4 shows a schematic representation of interaction between a bucket dovetail and a lockwire to substantially prevent circumferential rotation of the lockwire in accordance with a first exemplary embodiment of the invention.

FIG. 4 schematically illustrates one exemplary but nonlimiting technique for substantially preventing rotation of the lockwire 136 which is otherwise similar to lockwire 36 and includes overlapped free ends 138, 140. In a complete set of buckets assembled on a turbine rotor wheel, one of the buckets 116 (known as the locking bucket) contains a radial slot 46 (also shown in dotted lines in FIG. 1 for context) formed in the lock tab 132 that facilitates lockwire removal. This first technique for preventing lockwire rotation takes advantage of the presence of the radial slot 46. Specifically, an axially-oriented dowel pin 48 (similar to pins 42) is inserted in a hole formed in the lockwire 136 (e.g. brazed in a counter-bored hole before lockwire installation). During installation of the lockwire 136, the pin 48 is located within the radial slot 46, extending in an axial direction normal to the face 50 of the lock tab 132, thus limiting and substantially preventing any rotation of the lockwire 136 during operation of the turbine, thus keeping free ends 138,140 over-lapped.

Figure 5:
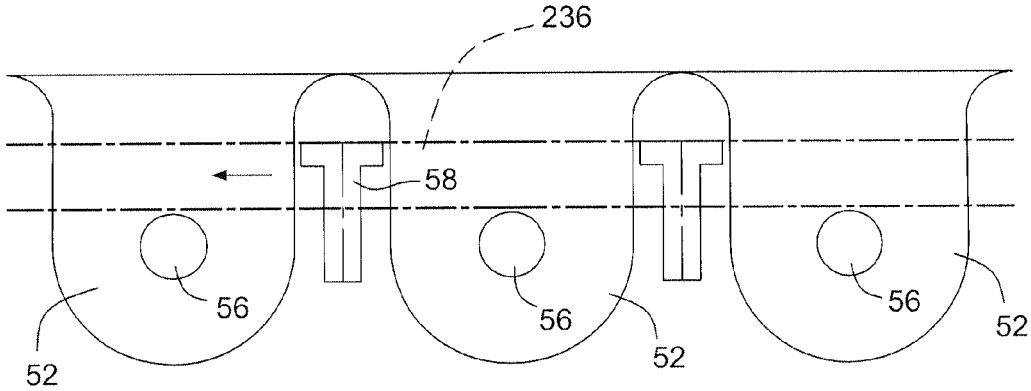
FIG. 5 shows a schematic representation of interaction between a bucket dovetail and a lockwire to limit circumferential rotation of the lockwire in accordance with a second exemplary embodiment of the invention.

FIG. 5 schematically illustrates a second exemplary but nonlimiting technique for limiting rotation of the lockwire 236. Here, the circumferentially-spaced radial tabs 52 represent portions of the turbine wheel similar to the radially projecting portions 24 through which the lockwire 236 passes. Axially oriented retaining pins 56 are again utilized to hold the lockwire within the slots behind the tabs. In this case, a small hole is counter bored in the lockwire 236, substantially transverse or perpendicular to the lockwire, and a dowel pin 58 is brazed (or otherwise suitably fixed) in the hole, the dowel pin 58 having a length sufficient to extend radially inwardly beyond the retaining pins 56 when the lockwire is located within its annular slot. In this way, any rotation of the lockwire 236 will be limited by engagement of the dowel pin 58 with the next adjacent retaining pin 56. Maximum effectiveness is realized when the dowel pin 58 is located in an area of maximum retaining pin density. It will be appreciated that more than one dowel pin 58 may be inserted through the lockwire 236 at locations spaced about the circumferential extent of the lockwire. When limiting as opposed to preventing lockwire rotation, it is important that the circumferential rotation be limited to a degree less than the extent of the overlap at the free ends 38, 40 (FIG. 3) of the lockwire.

Figure 6:
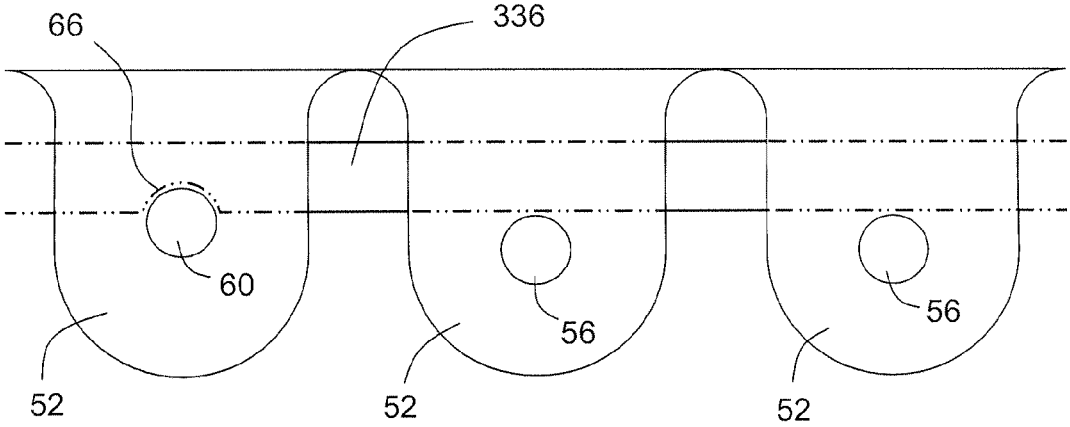
FIG. 6 shows a schematic representation of interaction between a bucket dovetail and a lockwire to prevent circumferential rotation of the lockwire in accordance with a third exemplary embodiment of the invention.

FIG. 6 illustrates yet another exemplary but nonlimiting technique for preventing rotation of a lockwire 336. In this case, the rotor wheel and bucket configuration is similar to that shown in FIG. 5, but in this instance, no pin is inserted through the lockwire itself. Rather, one of the retaining pins 60 is relocated on the rotor wheel 62 to a position radially outward of the remaining retaining pins 56. At the same time, the lockwire 336 is reformed (by machining, for example) to form a notch 66 along a radially inward surface to substantially match the curvature of the retaining pin 60. It will be appreciated that more than one notch 66 may be formed in the lockwire, and more than one retaining pin may be shifted radially outwardly to engage the one or more notches. In any event, the notch or notches 66 must have a slightly larger radius than the dowel pin(s) 60 to allow for thermal growth. When the lockwire notch 66 is engaged with the pin 60, circumferential rotation of the lockwire will be substantially prevented.

Figure 7:
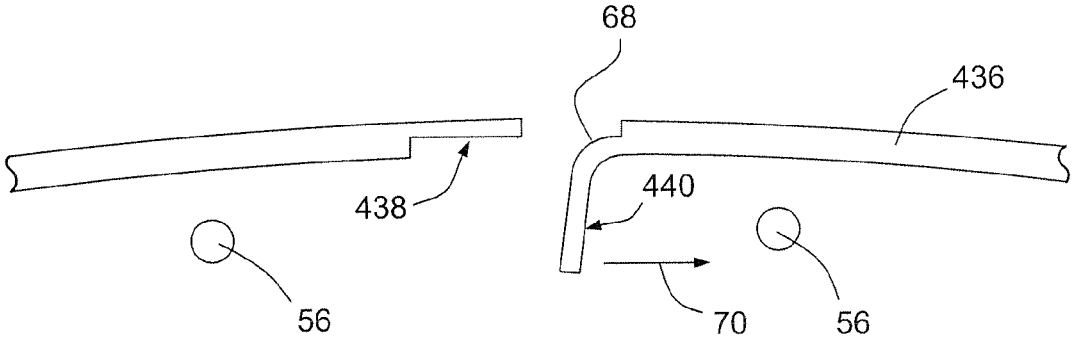
FIG. 7 shows a schematic representation of interaction between a bucket retaining pins and a lockwire to limit circumferential rotation of the lockwire in accordance with a fourth exemplary embodiment of the invention.

FIG. 7 illustrates yet another exemplary technique for preventing rotation of the lockwire 436. In this example, the leading free end 440 is bent inwardly (toward the turbine rotor centerline) at a location circumferentially between adjacent retaining pins 56 for a clockwise rotation direction of the lockwire, indicated by arrow 70. Here, if the lockwire does begin to rotate at any turbine speed, the bent portion 68 of the lockwire will quickly come to rest (or be hung up on) the nearest retaining pin 56. For a rotation direction opposite that shown in FIG. 7, the opposite free end 38 of the lockwire 436 would be bent inwardly to achieve the same rotation-prevention effect.

Accordingly, the "means" for limiting circumferential rotation of the lockwires 36, 136, 236, 336 and 436 include the various combinations of slot 46 and pin 48; pins 56, 58; pin 56, 60 and notches 66; and pins 56 and bent portion 68 as described herein.

Each of the above described exemplary but nonlimiting embodiments prevent bucket migration due to disengaged lockwires, an event that can potentially cause substantial damage, especially on a first-stage turbine bucket. It will be appreciated that the invention contemplates all equivalent arrangements for limiting or preventing rotational movement of the lockwire within the annular lockwire slot.

while the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A retention system for a plurality of turbine buckets located in respective mating slots in a turbine rotor wheel, the retention system comprising:

a plurality of first retention slots formed in outer peripheral portions of the turbine wheel;

a plurality of second retention slots formed in wheel mounting portions of said buckets, said first and second retention slots aligned to form an annular retention slot extending about a peripheral portion of said rotor wheel;

a lockwire located within said annular retention slot, said lockwire having engaged free ends;

a plurality of axially-oriented retaining pins fixed in said rotor wheel holding said lockwire in said annular retention slot; and at least one pin fixed to said lockwire and arranged to engage a tab on one of said buckets, to thereby limit circumferential rotation of said lockwire within said annular slot.

2. The retention system according to claim 1, wherein said tab comprises a radially-extending locking tab, said locking tab formed with a radially-extending groove, wherein said at least one pin extends axially away from said lockwire and is engaged within said groove.

3. The retention system according to claim 1 wherein said at least one pin extends radially inwardly from said lockwire a length sufficient to be engaged by one of said axially-oriented retaining pins and thereby limit rotation of said lockwire within said annular slot.

4. The retention system according to claim 3 wherein said at least one pin comprises plural pins.

5. The retention system according to claim 1 wherein said lockwire comprises a metal wire having free ends formed to provide a smooth overlap when said free ends are engaged.

6. A retention system for a plurality of turbine buckets located in respective mating slots in a turbine rotor wheel, the retention system comprising:

a plurality of first retention slots formed in outer peripheral portions of the turbine wheel;

a plurality of second retention slots formed in wheel mounting portions of said buckets, said first and second retention slots aligned to form an annular retention slot extending about a peripheral portion of said rotor wheel;

a lockwire located within said annular retention slot, said lockwire having overlapped free ends;

a plurality of axially-oriented retaining pins fixed in said rotor wheel holding said lockwire in said annular retention slot; and at least one notch formed in said lockwire in engagement with one of said retaining pins to thereby substantially prevent circumferential rotation of said lockwire within said annular slot.

7. The retention system according to claim 6 wherein said at least one notch comprises plural notches formed in said lockwire, said notches engaged by one or more of said retaining pins.

8. The retention system according to claim 7 wherein said one of said retaining pins is located radially outwardly relative to remaining ones of said retaining pins.

9. The retention system according to claim 6 wherein said lockwire comprises a metal wire having free ends formed to provide a smooth overlap when said free ends are engaged.

10. A retention system for a plurality of turbine buckets located in respective mating slots in a turbine rotor wheel, the retention system comprising:

a plurality of first retention slots formed in outer peripheral portions of the turbine wheel;

a plurality of second retention slots formed in wheel mounting portions of said buckets, said first and second retention slots aligned to form an annular retention slot extending about a peripheral portion of said rotor wheel;

a lockwire located within said annular retention slot, said lockwire having opposed free ends;

a plurality of axially-oriented retaining pins fixed in said rotor wheel holding said lockwire in said annular retention slot; and wherein a leading free end of said lockwire, relative to a direction of rotation of said rotor wheel, is bent inwardly toward a centerline of said rotor wheel enabling engagement with an adjacent one of said retaining pins to thereby limit circumferential rotation of said lockwire within said annular retention slot.

* * * * *

UNITED STATES PATENT AND TRADEMARK OFFICE

CERTIFICATE OF CORRECTION

PATENT NO. : 8,485,784 B2
APPLICATION NO. : 12/502715
DATED : July 16, 2013
INVENTOR(S) : John Alan Eastman It is certified that error appears in the above-identified patent and that said Letters Patent is hereby corrected as shown below:

In the Specifications:

At column 3, line 30, delete “including a shank portion 16” and insert --including a shank portion 18--

At column 5, line 11, delete “while the invention” and insert --While the invention--

Signed and Sealed this
Tenth Day of September, 2013

Teresa Stanek Rea
*Acting Director of the United States Patent and Trademark Office*